US007946059B2

(12) United States Patent
Borel

(10) Patent No.: US 7,946,059 B2
(45) Date of Patent: May 24, 2011

(54) SHOCK-ABSORBING SYSTEM FOR AN ARTICLE OF FOOTWEAR

(75) Inventor: René Borel, Saint-Sylvestre (FR)

(73) Assignee: Salomon S.A.S., Metz-Tessy (FR)

( * ) Notice: Subject to any disclaimer, the term of this patent is extended or adjusted under 35 U.S.C. 154(b) by 724 days.

(21) Appl. No.: 11/735,004

(22) Filed: Apr. 13, 2007

(65) Prior Publication Data

US 2007/0240331 A1 Oct. 18, 2007

(30) Foreign Application Priority Data

Apr. 14, 2006 (FR) ..... 06 03383

(51) Int. Cl.
*A43B 13/18* (2006.01)
*A43B 21/26* (2006.01)

(52) U.S. Cl. ..... 36/28; 36/35 R; 36/31

(58) Field of Classification Search ..... 36/28, 35 R, 36/30 R, 31, 36 A, 25 R, 34 R
See application file for complete search history.

(56) References Cited

U.S. PATENT DOCUMENTS

| | | | | |
|---|---|---|---|---|
| 5,224,810 | A | 7/1993 | Pitkin | |
| 5,343,639 | A | 9/1994 | Kilgore et al. | |
| 5,729,917 | A | 3/1998 | Slepian et al. | |
| 5,784,808 | A | 7/1998 | Hockerson | |
| 5,852,886 | A | 12/1998 | Slepian et al. | |
| 5,937,545 | A | 8/1999 | Dyer et al. | |
| 5,987,780 | A | 11/1999 | Lyden et al. | |
| 6,023,859 | A * | 2/2000 | Burke et al. | 36/105 |
| 6,266,897 | B1 | 7/2001 | Seydel et al. | |
| 6,438,870 | B2 * | 8/2002 | Nasako et al. | 36/28 |
| 6,487,796 | B1 | 12/2002 | Avar et al. | |
| 6,516,540 | B2 | 2/2003 | Seydel et al. | |
| 6,665,958 | B2 | 12/2003 | Goodwin | |
| 6,684,532 | B2 | 2/2004 | Greene et al. | |
| 6,691,432 | B2 | 2/2004 | Masseron | |
| 6,944,973 | B2 | 9/2005 | Goodwin | |
| 6,962,008 | B2 | 11/2005 | Manz et al. | |
| 6,968,636 | B2 | 11/2005 | Aveni et al. | |
| 7,013,583 | B2 | 3/2006 | Greene et al. | |
| 7,140,124 | B2 | 11/2006 | Manz et al. | |
| 7,159,339 | B2 | 1/2007 | Mathieu et al. | |
| 7,174,659 | B2 | 2/2007 | Delgorgue | |
| 7,418,792 | B2 * | 9/2008 | Pai | 36/30 R |
| 7,441,346 | B2 * | 10/2008 | Hardy et al. | 36/25 R |
| 7,464,489 | B2 * | 12/2008 | Ho | 36/28 |

(Continued)

FOREIGN PATENT DOCUMENTS

DE 20 2005 013 282 U1 1/2006

(Continued)

*Primary Examiner* — Jila M Mohandesi
(74) *Attorney, Agent, or Firm* — Greenblum & Bernstein, P.L.C.

(57) ABSTRACT

An article of footwear including an upper overlaying an outer bottom assembly, such assembly including, in the area of the heel, at least two support blocks made of a damping/shock-absorbing material and arranged on respective ones of the lateral and medial sides of the bottom assembly. Each of the support blocks extends vertically, substantially from the upper end to the lower end of the bottom assembly, the support blocks being deformable substantially independently of one another. Further, the outer bottom assembly includes an elastically deformable element that includes an upper portion that extends transversely relative to the bottom assembly and covers the upper end of each of the support elements, as well as at least two legs which extend laterally and medially, respectively, and externally cover respective ones of the support elements, substantially over their entire heights.

32 Claims, 10 Drawing Sheets

U.S. PATENT DOCUMENTS

| | | | | |
|---|---|---|---|---|
| 7,484,319 | B2 * | 2/2009 | Cheskin et al. | 36/44 |
| 7,571,556 | B2 * | 8/2009 | Hardy et al. | 36/28 |
| 2001/0010129 | A1 * | 8/2001 | Russell | 36/27 |
| 2003/0093920 | A1 | 5/2003 | Greene et al. | |
| 2004/0123494 | A1 | 7/2004 | Goodwin | |
| 2005/0268491 | A1 * | 12/2005 | McDonald et al. | 36/28 |
| 2006/0112592 | A1 | 6/2006 | Leedy et al. | |
| 2007/0028484 | A1 * | 2/2007 | Akhidime | 36/28 |
| 2009/0013556 | A1 * | 1/2009 | Nishiwaki et al. | 36/28 |

FOREIGN PATENT DOCUMENTS

| | | | |
|---|---|---|---|
| EP | 1 402 795 | A1 | 3/2004 |
| WO | WO-98/07343 | A1 | 2/1998 |
| WO | WO-2006/057764 | A1 | 6/2006 |

* cited by examiner 21
27
23
20
25
22
24
37
30
34
34a
40
37
31a
44d
31b
44
35
34
31
42c
42
36a
35
35a
36
46
41
43
60
41c
43c
47

SHOCK-ABSORBING SYSTEM FOR AN ARTICLE OF FOOTWEAR

CROSS-REFERENCE TO RELATED APPLICATION

This application claims priority under 35 U.S.C. §119 of French Patent Application No. 06.03383, filed on Apr. 14, 2006, the disclosure of which is hereby incorporated by reference thereto in its entirety.

BACKGROUND OF THE INVENTION

1. Field of the Invention

The invention relates to a shock-absorbing system for footwear, particularly sports footwear, such as walking shoes, running shoes, and the like. More particularly, the invention relates to an article of footwear having such system, such system comprising a shock-absorbing bottom assembly.

2. Description of Background and Relevant Information

There are a large number of shock-absorbing, or damping, systems for sports footwear, which are adapted to damp the reactive forces coming from the ground during the course of walking or running, or during other movement.

These damping devices are conventionally designed for damping the reactive forces that occur mainly perpendicular with respect to the surface of the ground, that is, primarily vertically directed forces. Indeed, the reactive forces occurring in this direction are conventionally considered as being the most substantial. Therefore, these vertical reactive forces are generally damped by merely providing a foam block generally made of EVA and which is vertically deformable. Other means using pockets filled with fluid or gas are also known.

Focus has been directed more recently to those ground reactive forces that occur in the plane of the ground, rather than vertically, which will be referred to hereinafter as the horizontal plane.

Depending upon the type of sport practiced, such horizontal forces are more or less substantial. For example, in sports such as tennis or basketball, where a number of movements are lateral, the reactive forces occurring along the ground plane can be very high.

The horizontal reactive forces that occur when running on asphalt are higher, because the high coefficient of friction of asphalt stops any relative horizontal movement of the sole with respect to the ground, which is not the case when running on looser ground, on which ground/sole relative movements can occur.

This finding has led to new footwear constructions, in which the sole damping devices are designed so as to permit a certain relative movement of the sole with respect to the ground, and/or shearing movements within the sole itself, in order to absorb the forces occurring in an essentially horizontal plane and to reproduce the effects of running on loose ground.

Such constructions are known, for example, from the documents U.S. Pat. Nos. 6,487,796, 5,343,639, 6,962,008, EP 1 402 795, and U.S. Pat. No. 5,224,810.

These documents generally teach damping only in the horizontal plane.

The documents WO 98/07343 and U.S. Pat. No. 6,266,897 disclose a construction in which pocket-like elements filled with fluid can deform in all three directions, that is, in the horizontal plane as well as in the vertical direction.

The drawback of such a construction is that deformations in any of the directions are uniform. Therefore, it is not possible to distinguish/dissociate the vertical damping from the horizontal damping.

Another problem common to all of the damping devices is in reconciling damping and stability of the foot on the ground, such as the "grip" the shoe has relative to the ground, these functions being more or less incompatible.

SUMMARY OF THE INVENTION

The present invention remedies the drawbacks of the prior art and provides an improved damping, or shock-absorption, device.

More particularly, the invention provides a device for damping in three different directions, that is, along a horizontal plane as well as along a vertical direction.

Still further, the invention provides a damping device that has good grip and/or "road stability".

According to a particular description, the invention includes an upper overlaying an outer bottom assembly, the outer bottom assembly including, in the area of the heel, at least two support elements made of a damping material and arranged on the lateral and medial sides, respectively, of the bottom assembly, each element extending vertically, substantially from an upper end up to a lower end of the outer bottom assembly, the support elements being deformable substantially independently of one another, and the outer bottom assembly including an elastically deformable element having an upper portion that extends transversely with respect to the bottom assembly and which covers the upper end of each of the support elements, and at least two legs extending laterally and medially, respectively, and externally surrounding each of the support elements substantially over their entire height.

This construction enables damping in all directions while ensuring that the footwear has good stability and grip.

Indeed, in the case of an essentially vertical force, the support elements are compressed and absorb the energy thus generated. Because they are independent and not connected at their lower end by a common walking sole, as is the case in the known devices, the support elements also move apart from one another with respect to the longitudinal axis of the footwear and thus increase the support polygon. As a result, the footwear stability is necessarily increased.

BRIEF DESCRIPTION OF DRAWINGS

The invention will be better understood, and other characteristics thereof will become apparent from the description that follows, with reference to the annexed schematic drawings showing several embodiments, by way of non-limiting examples, and in which.

DETAILED DESCRIPTION OF THE INVENTION

FIGS. 1 to 6 illustrate the construction and functioning of a shock-absorbing bottom assembly for an article of footwear 1 according to a first embodiment of the invention. The article of footwear 1 shown is a sports shoe, a running shoe in particular, although any other type of sports footwear could, alternatively, be depicted. The shoe 1 is shown in a perspective bottom view in FIG. 1, which shows the tread blocks, or support elements, of the outersole extending upwardly. The shoe 1 includes an upper 2 that overlays an outer bottom assembly 10.

With the expression "outer bottom assembly" or "bottom assembly," reference is made herein to an assembly of the bottom parts of an article of footwear, i.e., those parts which are positioned beneath the upper, as the article of footwear is worn. In this regard, the outer bottom assembly 10 does not include sole portions such as the insole, sock, Strobel sole, or lasting insole, which can be directly connected to the upper 2 and/or arranged therein. The upper 2 is fixed to the outer bottom assembly 10 in any known manner, such as by means of glue, stitching, staples, or various expedients known to those skilled in the art.

Figure 1:
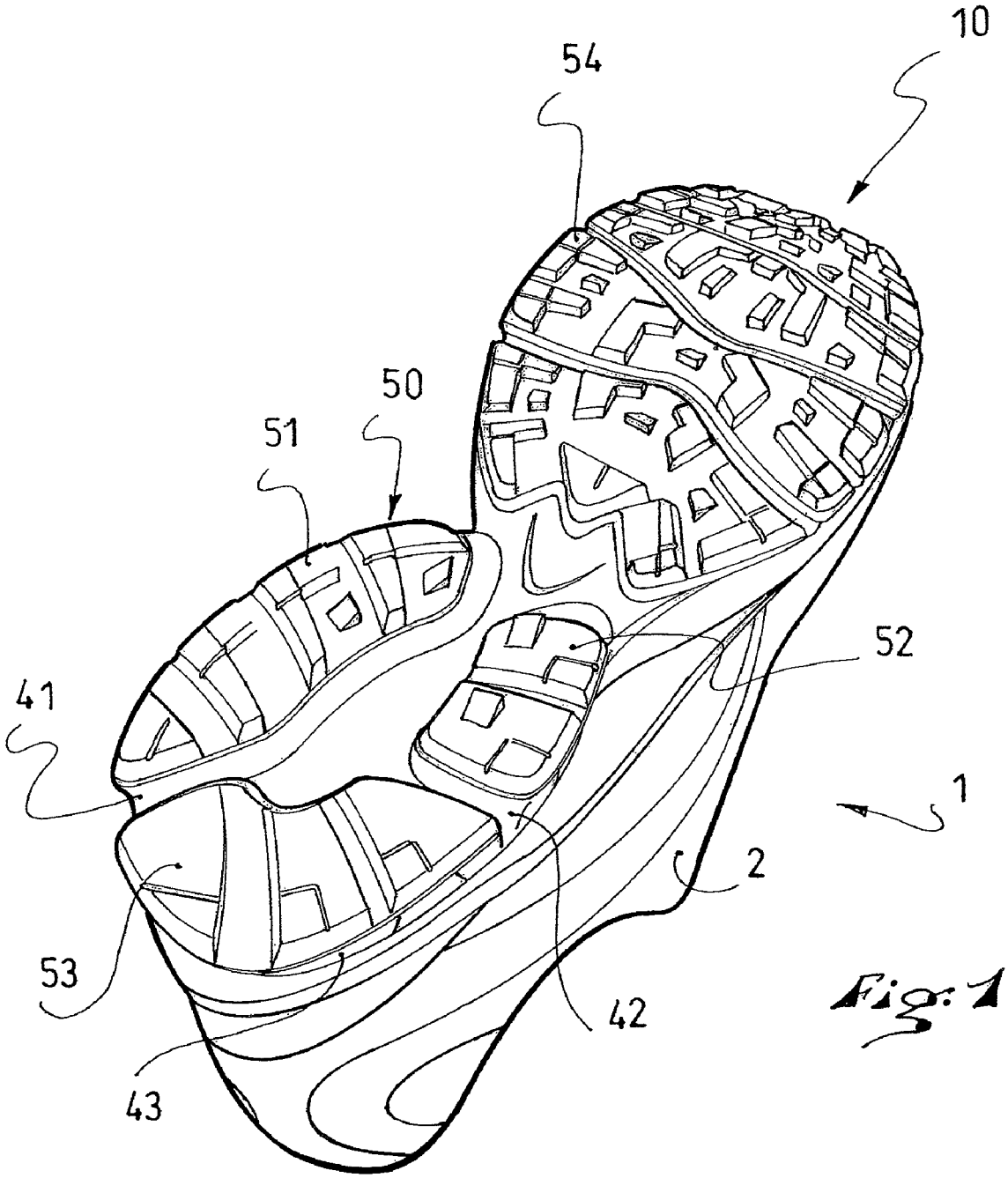
FIG. 1 is a perspective bottom view of shoe including a shock-absorbing bottom assembly according to the invention.
Figure 2:
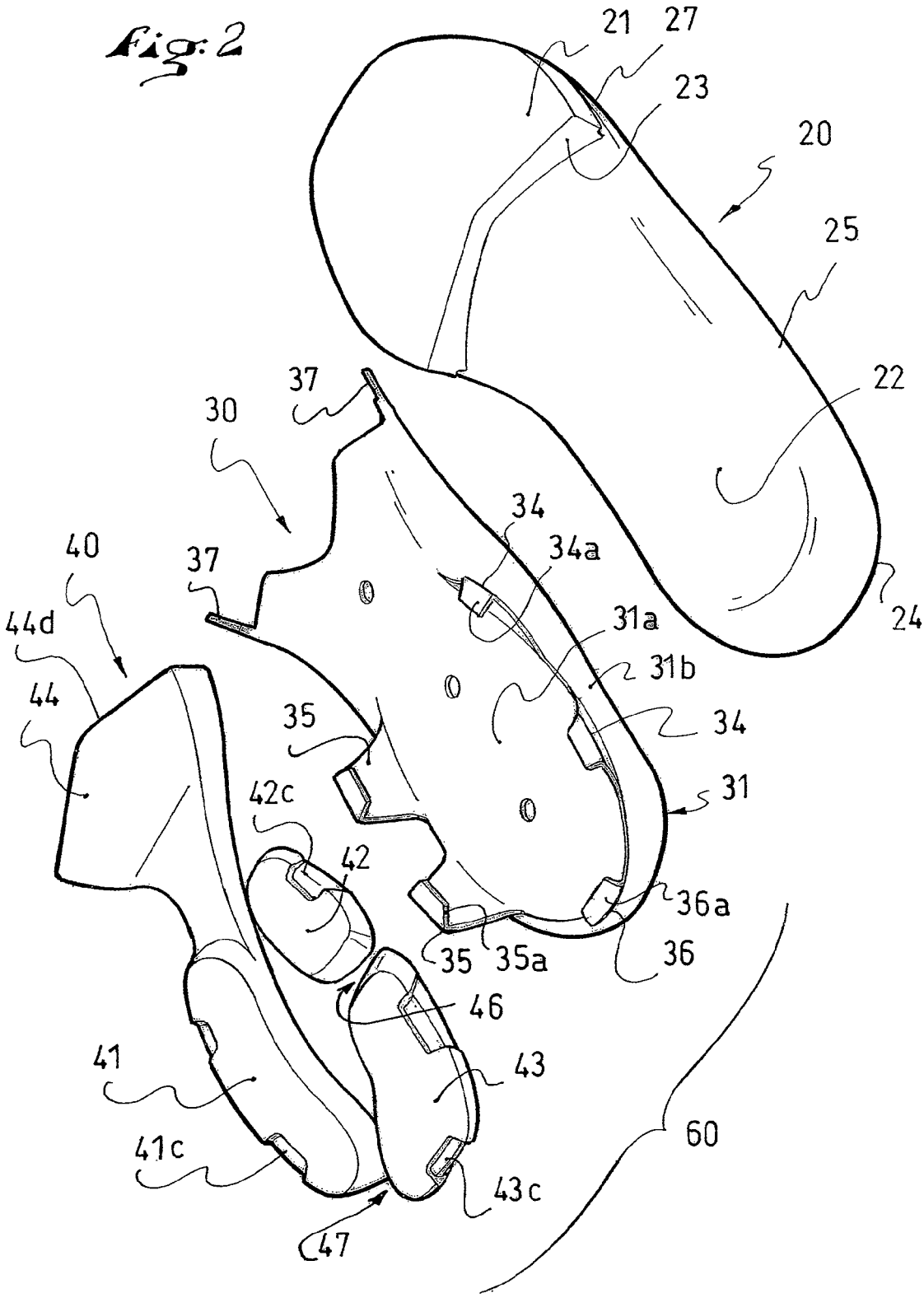
FIG. 2 is an exploded perspective view of the bottom assembly according to the invention, without a contact layer.
Figure 3:
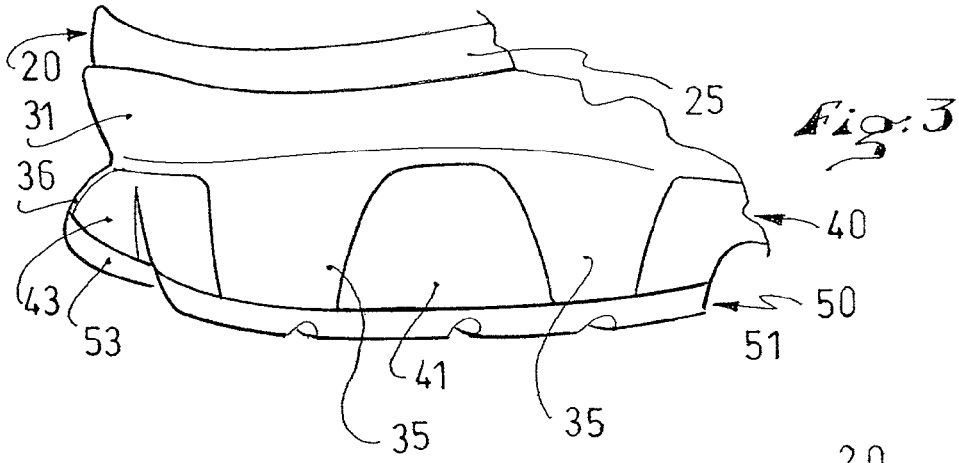
FIG. 3 is a side view of the rear portion of the bottom assembly of FIG. 1.

As shown more particularly in FIGS. 2 and 3, the outer bottom assembly 10 includes, from top down, an upper damping layer 20, or shock-absorbing layer, an elastically deformable element 30, a plurality of damping/shock-absorbing, i.e., compressible, support elements 40 and a ground contact layer 50 (not shown in FIG. 2 for reasons of clarity).

The upper damping layer 20 extends over the entire length of the bottom assembly 10, or substantially over the entire length, that is, from the rear end to the front end thereof, and includes a front portion 21 and a rear portion 22, respectively, having a uniform thickness, or substantially uniform thickness. The front portion 21 is thicker than the rear portion 22, with a thickness, for example, on the order of 4 millimeters (mm) to 15 mm. The rear portion 22 has a thickness, for example, on the order of 3 mm to 10 mm. In the example shown, the front portion 21 is ended at the rear by a chevron-shaped portion 23, which forms a step in relation to the rear portion 22, and the function of which is explained below. Alternatively, any shape other than the chevron shape 23, such as a wave shape, e.g., can be provided. The upper portion 24 of the upper damping layer 20 is substantially flat/planar or adapted to the shape of the upper. It can also have vertical, or substantially vertical, edges or sides 25 adapted to rise along the upper 2. These edges 25 are higher in the rear zone, especially in the heel zone, and the elastically deformable element 30 includes in the heel area a bowl-shaped portion 31, that is, a portion having a relatively flat bottom 31*a*, or base, that assumes the shape of the upper damping layer 20. In this regard, edges/sides 31*b* extend upwardly from the base 31*a*, rising along the upper or the edges 25 of the upper damping layer 20. As shown in FIGS. 2 as well as in FIGS. 4 and 5, the base 31*a* of the bowl-shaped portion 31 of the elastically deformable element 30 extends transversely substantially across the entirety of the width of the bottom assembly. The bowl-shaped portion 31 further includes a number of projections/legs that extend downwardly from the base 31*a* of the elastically deformable element 30. Included, in the example shown, are two lateral legs 34, two medial legs 35, and a rear leg 36 that are adapted to cooperate with the support elements, as will be described further below. The number of legs could be different depending on the desired result to be achieved according to the invention.

Each leg 34, 35, 36 extends from the rear bowl-shaped portion 31 to the bottom and has a free end in the form of a return 34*a*, 35*a*, 36*a*, respectively, adapted to be inserted between the damping support elements 40 and the contact layer 50. These returns 34*a*, 35*a*, 36*a*, are essentially adapted to ensure that the legs 34, 35, 36 and the contact layer 50, as well as the support elements 40 adhere properly to one another. The returns can be omitted within the scope of the invention, whereby each of the legs would extend downwardly, terminating with the respective support elements 40 at a downwardly facing free end. In either case, the free end of the legs would be positioned proximate the lowermost surfaces of the support elements.

In the example shown, the legs 34, 35, 36 are relatively planar/flat and, in the cross section of the bottom assembly, they are slightly inclined in relation to the vertical direction V (see FIG. 4), adjacent legs being more widely spaced apart toward the lower end of the bottom assembly, i.e., the legs extending downwardly and outwardly from the base 31*a*. Another way of describing this feature is, with reference to FIGS. 4 and 5, that each of the legs 34, 35 extends from an uppermost extent to a lowermost extent, with the lowermost extent of each of the legs also being the outermost transverse extent, i.e., laterally and medially, respectively.

Further, as shown in FIGS. 2 and 3, the legs 34, 35, 36 have, in the example shown, a slightly triangular shape that narrows down toward the bottom. Other shapes can be provided depending upon the function of the elastic element. Thus, the legs can be undulated, rather than planar/flat, so as to promote damping in the vertical direction. It is also contemplated, within the scope of the invention, that the legs could extend only over a portion of the height of the blocks.

The elastically deformable element is extended forward by two planar/flat arms 37, the function of which is explained below. The element 30 is made of a relatively rigid and elastic material having a Young's Modulus greater than 40 MPa. It can be made of a synthetic or composite material, such as TPU, PE, reinforced or non-reinforced polyamide, elastomeric polymer (Hytrel®, e.g.), PEBA, carbon/resin fiber-base composite, or other material.

The upper damping layer 20 can be made of EVA or PU foam, with a hardness greater than 20 Asker C, or substantially greater than 20 Asker C.

The damping support elements 40 comprise blocks of damping materials, arranged between the elastically deformable element 30 and the contact layer 50.

In the first embodiment, the support elements 40 are independent and as many as three, namely, a medial block 41 arranged on a medial side of the shoe, two lateral blocks 42, 43 arranged on the lateral side of the shoe. In other words, the support element 41 extends at least on the medial side of a vertical longitudinal median plane and the support elements 42, 43 extend at least on the lateral side of a vertical longitudinal median plane, although the support element 43 extends to or beyond the vertical longitudinal median plane. The medial block 41 is slightly arched so as to follow the contour of the bottom assembly and extends substantially over the entire length of the heel zone of the bottom assembly. This medial block 41 cooperates with the two medial legs 35 of the elastically deformable element 30. The forwardmost lateral block 42 has a substantially paralellepipedic shape and cooperates with only one lateral leg 34 of the elastically deformable element 30. The rearmost lateral block 43 extends on the lateral side and over a portion of the rear of the heel and cooperates with a lateral leg 34 and a rear 36 leg, respectively, of the elastically deformable element. The number of legs could be different for each block, according to the invention.

The lateral block 43 also has the shape of an arc-of-a-circle, or substantially so, so as to assume the contour of the heel.

In the illustrated embodiment, the lateral block 43 has substantially the same length as the medial block 41, but could have a different length. For example, the medial block 41 could be longer. The two lateral blocks 42, 43 are separated by a slit-shaped space 46 that is substantially perpendicular to the edge of the bottom assembly, whereas the medial and lateral blocks 41, 43 are separated by a slit-shaped space 47 that is also substantially perpendicular to the edge or contour of the bottom assembly in the zone considered.

The support blocks 41, 42, 43 are assembled to the elastically deformable element, independently of one another, by their upper ends 41*a*, 42*a*, 43*a*, respectively. In the example shown, the medial block 41 is extended toward the front of the shoe, i.e., beyond the plantar arch, by a slightly thinner damping layer 44 ended by a triangular or chevron-shaped 44*d* portion that is complementary of that of the front portion 21 of the upper damping layer 20, so as to ensure the shape these two layers fit one another. Alternatively, other forms can be used according to the invention. The thickness of the layer 44 corresponds to that of the step 23 of the chevron. In practice, the blocks 41, 42, 43 are made of elastomerized EVA foam, or PU foam having a 20 Asker C hardness. Indeed, the behavior of such foams is concurrently damping and elastic. As the case may be, more damping foams, such as non-elastomerized EVA foams, can be provided as alternatives within the scope of the invention. In the example shown, the blocks have a vertical thickness ranging from 10 mm to 30 mm, for example, such as 20 mm, or on the order of 20 mm, or a thickness within any range within said range.

The elements 30 and 40 are pre-assembled into a subassembly 60 prior to assembly to the damping layer 20 to form the bottom assembly 10. The arms 37 are housed in recesses 27 of the layer 20 to consolidate the assembly.

As also clearly shown in FIG. 2, each block 41, 42, 43 is provided with one or two recesses 41*c*, 42*c*, 43*c*, respectively, for receiving the associated leg 34, 35, 36 of the elastically deformable element 30. These recesses have shapes that are complementary of those of the associated legs.

Depending upon the embodiment, these recesses could also be omitted.

The contact layer 50 is constituted of rear medial 51, rear lateral 52, 53, and front 54 elements, respectively, adapted to be fixed to the lower ends 41*b*, 42*b*, 43*b*, 44*b*, respectively, of the support blocks 41, 42, 42, 44, respectively, and of the damping layers 44 and 21, respectively.

The contact layer 50 is made of a wear-resisting material with adherence properties, such as rubber, TPU, or non-abrasive EVA foam, e.g., the latter two materials having the advantage of being lighter than rubber. As the case may be, and depending upon the material used for the support blocks and/or the damping layer, this contact layer 50 can be reduced, or even eliminated.

The combination of an elastically deformable but structurally rigid element 30 and damping support blocks 40 makes it possible to ensure a good damping in all directions, that is, a three-dimensional damping, since the damping blocks 40 are independent, while guaranteeing the stability of the assembly due to the elastic element 30. Furthermore, due to the various shapes of the blocks 41, 42, 43, and to the various numbers/shapes of legs per associated block, the damping characteristics of the blocks can be dissociated between the blocks, on the one hand, and between the vertical and horizontal directions, on the other hand. The functioning of the assembly is shown more particularly in FIGS. 4 to 6. With reference to the transverse cross sectional views of FIGS. 4 and 5, the inner and outer surfaces of each of the support blocks 41 and 43, similar to the legs 34, 35 of the elastically deformable element 30, mentioned above, extend from an uppermost extent to a lowermost extent, with the lowermost extent of each of the inner and outer surfaces of the support blocks 41, 43 also being the outermost transverse extent, i.e., laterally and medially, respectively.

Figure 4:
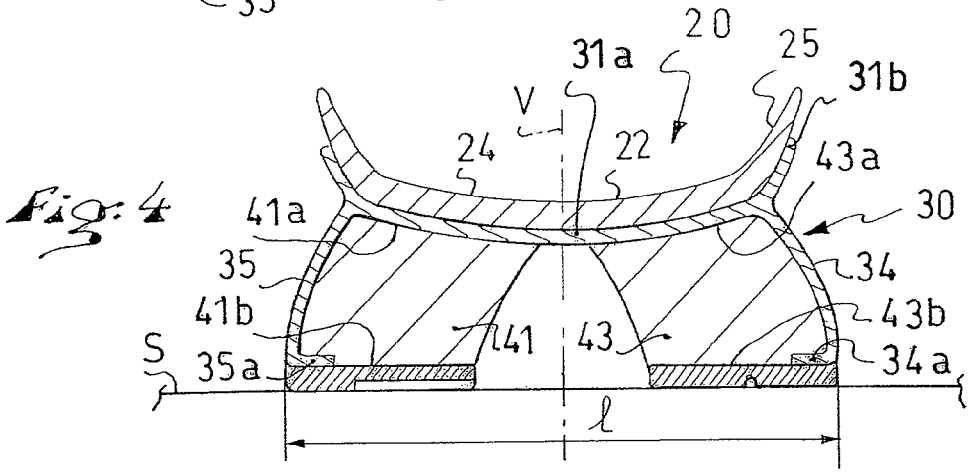
FIGS. 4 and 5 are schematic, transverse cross-sectional views showing the functioning of the bottom assembly in the case of a vertical force.

FIG. 4 shows the bottom assembly 10 according to the invention as laid flat on a ground surface "S", i.e., on a horizontal surface, without any force. In this configuration, the support blocks 41, 42, 43 define a support polygon, i.e., a support base, having a width "l".

Figure 5:
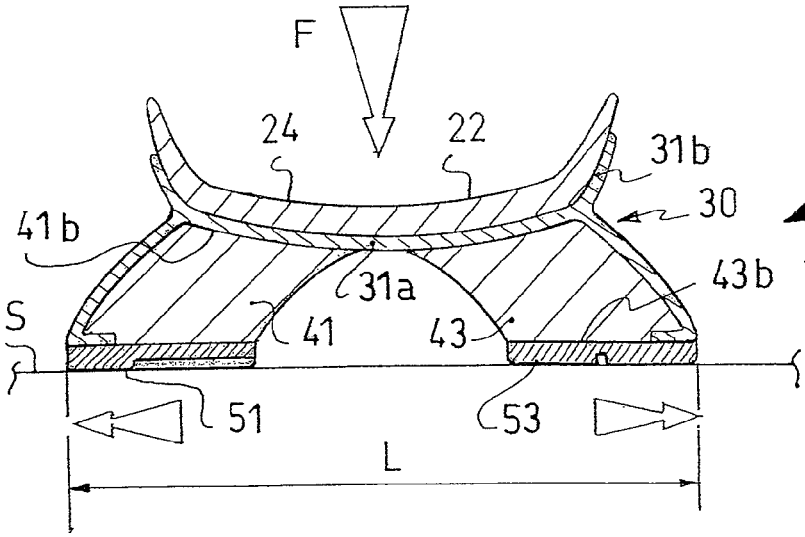
Figure 6:
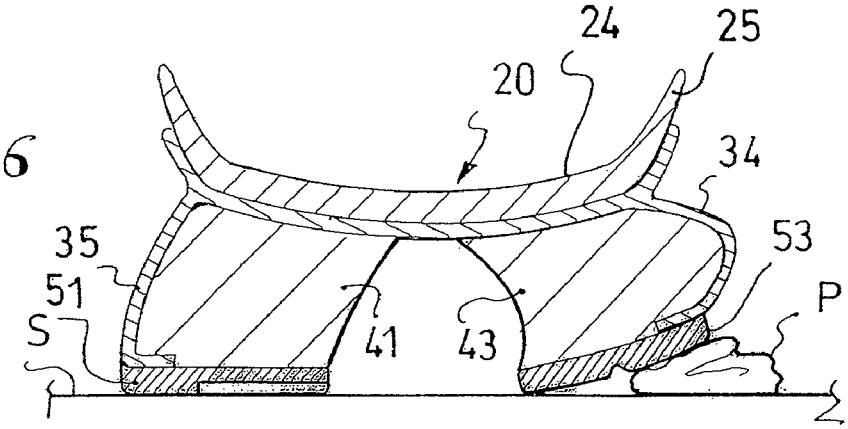
FIG. 6 is a view, similar to FIGS. 4 and 5, showing the deformation of the bottom assembly in the case of uneven terrain.
Figure 6D:
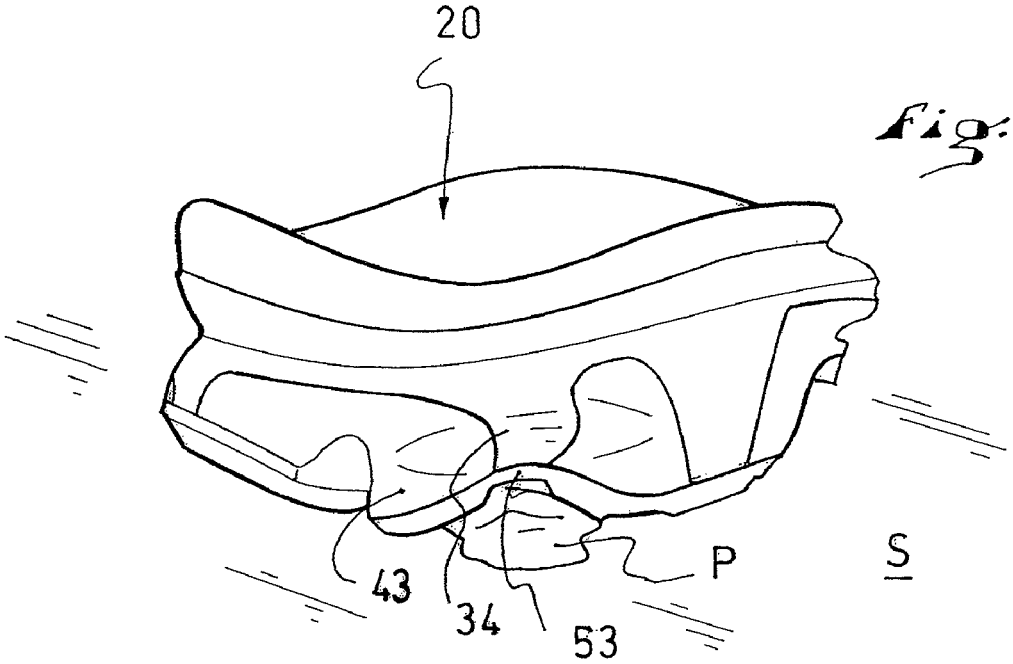
FIG. 6*a* is a side view of FIG. 6.

When a force "F" is applied to the bottom assembly in a substantially vertical direction, such as during walking or running, as shown in FIG. 5, and with the shoe engaging the ground surface S, the support blocks 40 deform and move apart from one another, stressing the elastic element 30, the legs 34, 35 flexing outwardly, and thereby define a new, larger support polygon, or support base, having a width "L" greater than the width "l" of the previous polygon, or support base. In other words, the perimeter of the support zone is larger and the stability in the area of the bottom assembly is increased. Stated another way, a closed perimeter or boundary line containing and abutting the lowermost surfaces of all of the support blocks 41, 42, 43 in the loaded configuration of the bottom assembly, shown in FIG. 5, is larger than such perimeter or boundary line in the unloaded configuration shown in FIG. 4.

As soon as the application of force "F" is discontinued, the elastically deformable element 30 exerts a return force and tends to bring the support blocks 40 back to the initial position shown in FIG. 4. In practice, when a wearer is running, the heel support block 43 is first biased, since it is the first in contact with the ground; then, depending upon the morphology of the user (pronator, supinator), the lateral 42 or medial 41 block comes in contact with the ground, followed by the opposite block, thus causing the spacing apart of the blocks 41, 42.

Because the support blocks 40 are independent, they can therefore deform independently of one another in order to adapt to the foot movement or to the terrain configuration. Thus, in FIGS. 6 and 6*a*, only the support block 43 and the associated leg 34 deform due to a pebble "P" that is encountered during use of the shoe. This isolated deformation of the support block 43 is, in this case, made possible by the legs, also deformable independently of one another, of the elastically deformable element 30. The construction according to the invention is therefore particularly advantageous for use on loose and uneven terrain.

Figure 7:
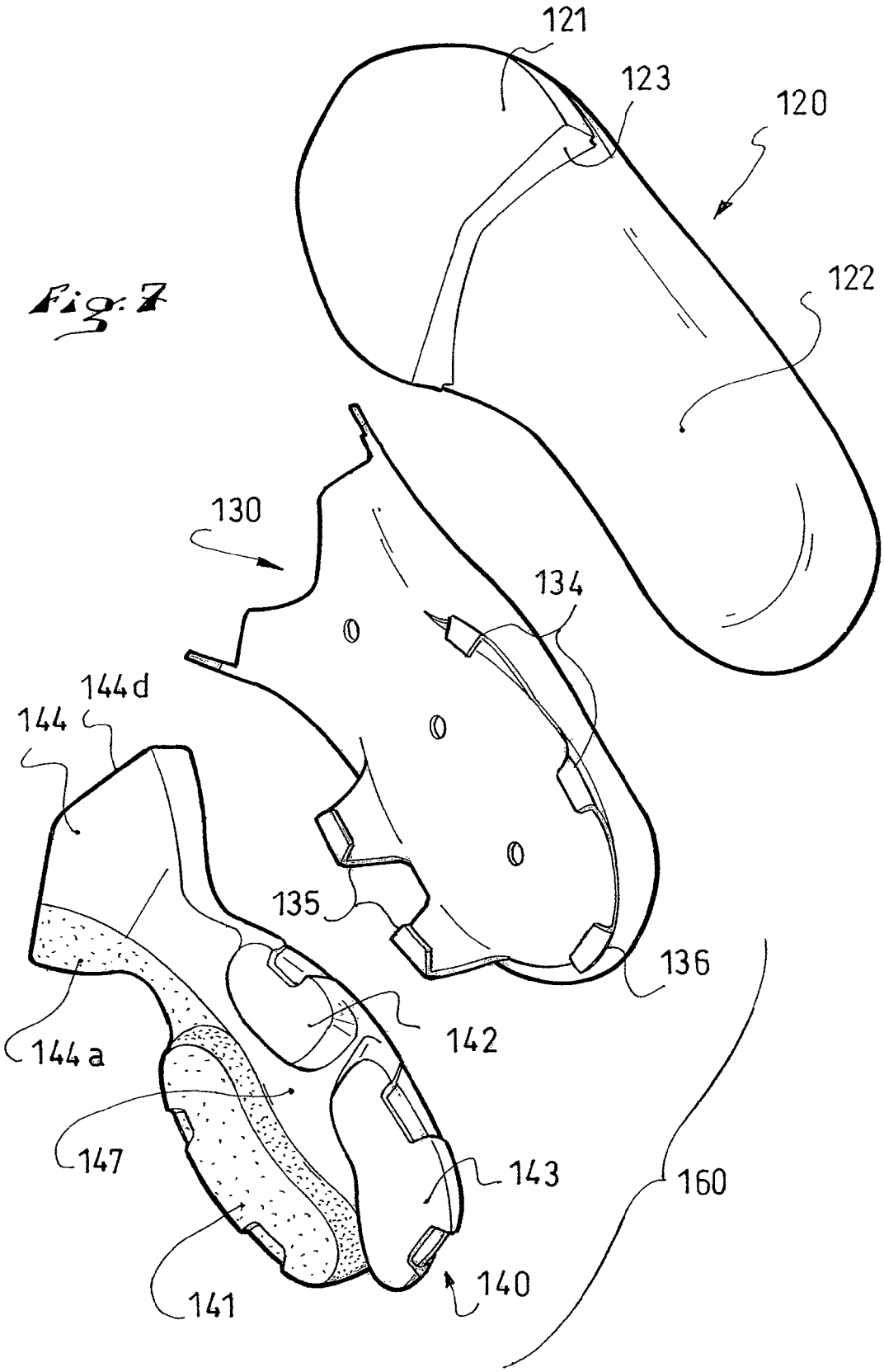
FIG. 7 is a view similar to FIG. 2 according to a second embodiment.
Figure 8:
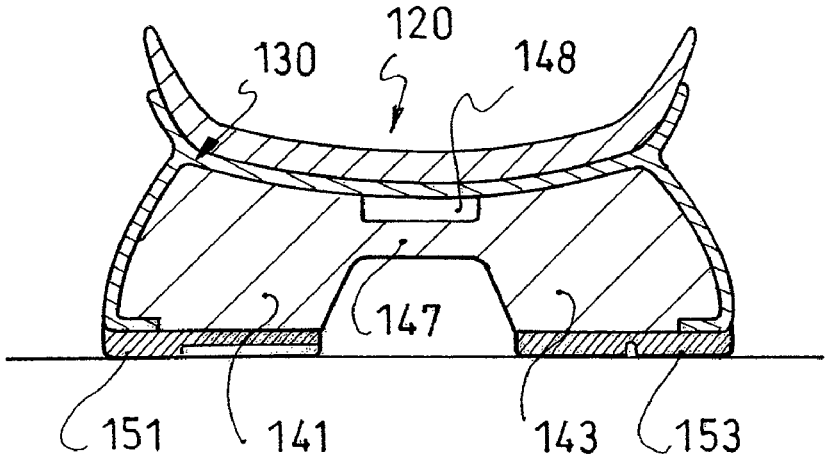
FIGS. 8 and 9 are views, similar to FIGS. 3 and 4, relating to the second embodiment.
Figure 9:
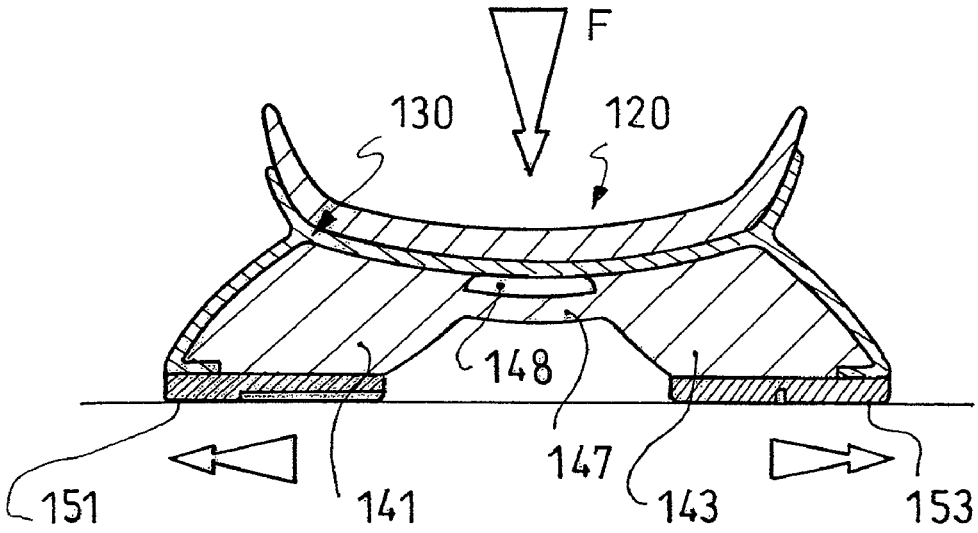

FIGS. 7 to 9 show a second embodiment in which similar or identical elements are designated by the same reference numerals increased by 100.

In this embodiment, a primary difference, relative to the embodiment described above, resides in the fact that the damping support blocks 141, 142, 143 are connected to one another by a bridge or wall 147 of material. Because the wall 147 is very thin, on the order of 3 mm to 10 mm, relative to the support blocks 141, 142, 143, the latter are always free to move independently of one another. However, the fact that they are connected makes it easier to assemble them.

Furthermore, when a force "F" is exerted on the outer bottom assembly shown in FIG. 7 (comprising upper damping layer 120, elastically deformable element 130, and damping support elements 140), and the latter is compressed by this force, as shown in FIG. 9, the material wall 147 is biased in traction and, when returning, also tends to return the bottom assembly to its original form as soon as the application of force is discontinued.

To enable this elastic return effect of the wall 147, the wall is not adhered to the elastically deformable element 130. Instead, it is separated therefrom by a cavity or space 148.

Another difference between the two aforementioned embodiments is the that the damping blocks 141, 142, 143, 144 are formed as a unitary element.

Finally, the medial support block 141 is made of a material that is similar to that of the remainder of the assembly 140, such as EVA foam, for example, but with a greater hardness, such as between 50 and 65 Asker C, for example. It is also extended to the portion 144 by a portion 144*a* having the same hardness. Alternatively, the support block 141 can be made of a different material, with the goal of being slightly harder (therefore less damping than the other blocks). This function is also linked to the pronator/supinator type of the shoe.

Figure 10:
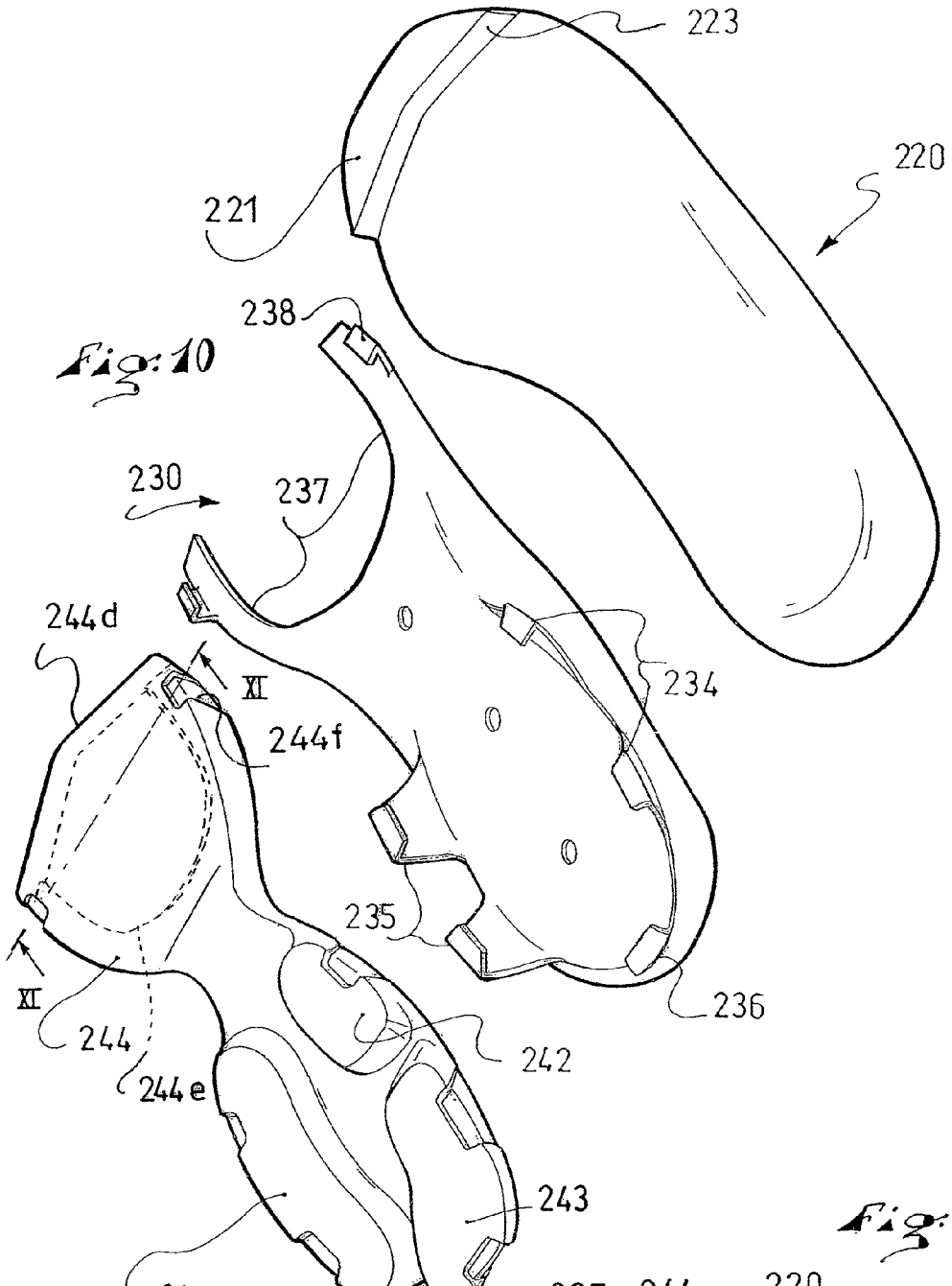
FIG. 10 is a view, similar to FIG. 2, of an bottom assembly according to a third embodiment.
Figure 11:
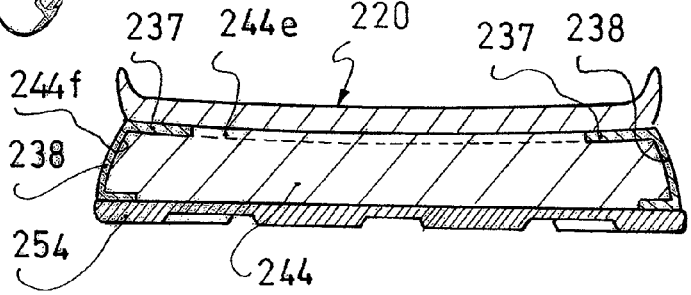
FIG. 11 is a cross-sectional view along the line XI-XI of FIG. 10.

In the embodiment shown in FIGS. 10 and 11, similar or equivalent elements are designated by the same reference numerals used in FIGS. 7 to 9, increased by 100.

In this case, the damping support elements 241, 242, 243 of the outer bottom assembly are also grouped in a single block 240. Compared to the previous embodiments, where the element 40, 140 stops shortly after the plantar arch, the element 240 here extends up to the area of the shoe corresponding to the metatarsophalangeal articulation zone of the wearer's foot, and is therefore longer.

The extra thick portion 221 of the damping layer 220 is consequently reduced and only extends from the front of the sole to the metatarsophalangeal articulation zone (defined in this case by the step 223). Furthermore, the elastically deformable element 230 has two elongated horizontal arms 237 at the front, which form a sort of fork.

The elongated arms 237, therefore, extend into the metatarsophalangeal articulation zone demarcated by the limits 223, 244*d*, and make it possible to provide the bottom assembly, in its front zone, with an additional elastic restoration. Furthermore, these arms 237 each include a leg 238 similar to the legs 234, 235, 236, and extend substantially vertically along the front portion 244 of the support block 240.

The vertical legs 238, as is the case with the legs 234, 235, 236, increase the stability of the bottom assembly.

In the illustrated embodiment, the arms 237 and lugs 238 of the elastically deformable element 230 are housed in associated recesses 244*e*, 244*f* of the support block, these recesses having complementary shapes and being arranged on the upper surface and the sides, respectively, of the front portion 244 of the support block 240.

FIGS. 12 to 17 show other embodiments of the invention in which the elements are designated by the same reference numeral used in FIGS. 10 and 11, increased each time by 100.

In these various embodiments, the bottom assembly includes at least two support elements, but additional return/stabilization arrangements are also provided.

Figure 12:
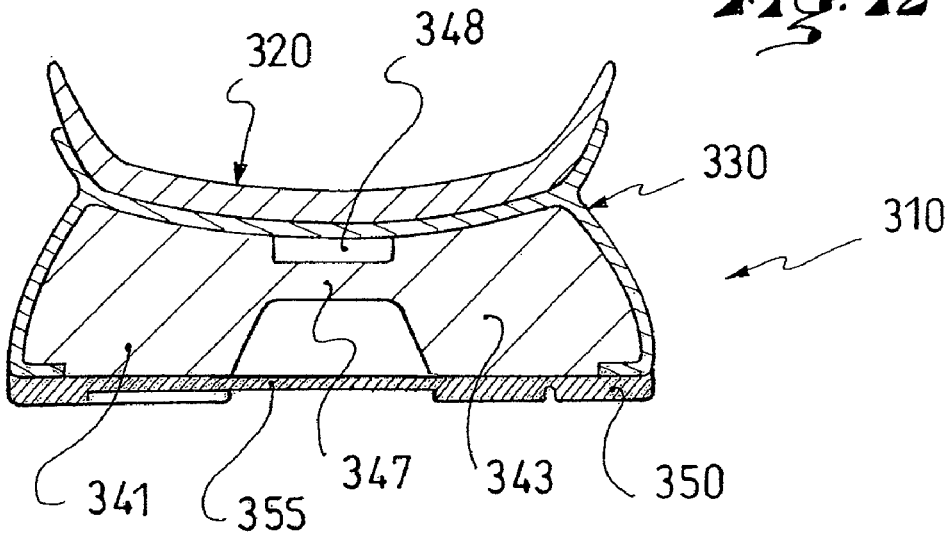
FIG. 12 is a view similar to FIG. 4 relating to a fourth embodiment.

In the embodiment of FIG. 12, the bottom assembly 310 therefore includes at least two independent damping support elements 341, 343 externally covered substantially over their entire height by an elastically deformable element 330 and provided with a walking sole or contact layer 350.

As in the embodiment of FIG. 8, the support elements 341, 343, while remaining independent, are connected by a material wall 347 made in the same material as the support element 341, 343, making it easier to assemble the bottom assembly, and which also enables a certain elastic return (not visible in the drawing) of the support elements 341, 343, 342 toward one another after compression.

In order to reinforce the elastic return effect, the contact layer 350 is also provided so as to connect the various support blocks 341, 342, 343 and, therefore, includes a material wall 355 connecting these various elements in the area of their lower end. Because the contact layer 350 is made of a very elastic material, such as rubber or any elastomerized material, it enables an advantageous effect of elastic return of the bottom assembly toward the original position.

Such a construction enables an additional stabilizing effect. In practice, this rubber wall 355 makes it possible to avoid up to 5 mm of residual spacing of the blocks after the return to the original position.

In other words, almost any residual deformation that would result in the spacing apart of the blocks is avoided. In practice, a residual deformation of 5 mm to 8 mm is avoided over the width of the sole.

The rubber wall 355 (or any other material) can be provided individually, i.e., independent of the wall 347.

Figure 13:
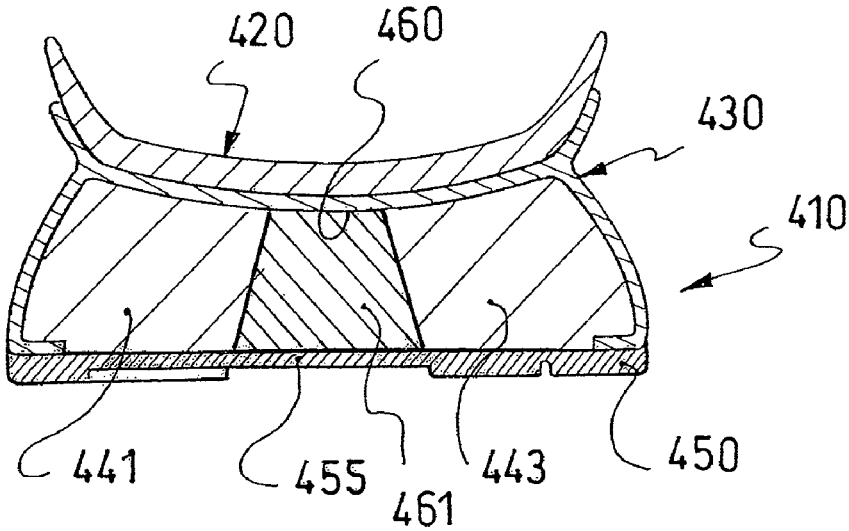
FIG. 13 is a view similar to FIG. 4 relating to a fifth embodiment.

FIG. 13 shows a similar embodiment, in which only the rubber wall 455 is provided.

In this case, the space 460 between two support elements 441, 443, 442 is filled with a material 461 such as EVA, PU, or gel, adapted to avoid having a hole behind the material wall 455. The space 460 can be filled by localized extensions, with a smaller cross section, of the material of the support elements 441, 442, 443, as defined, for example, by the arms 355*a*, 355*b*, 355*c* in FIG. 16 (FIG. 13 then being considered as a cross-sectional view along the line XIII-XIII of FIG. 16), or the arms 355*d*, 355*e* of FIG. 17.

Figure 14:
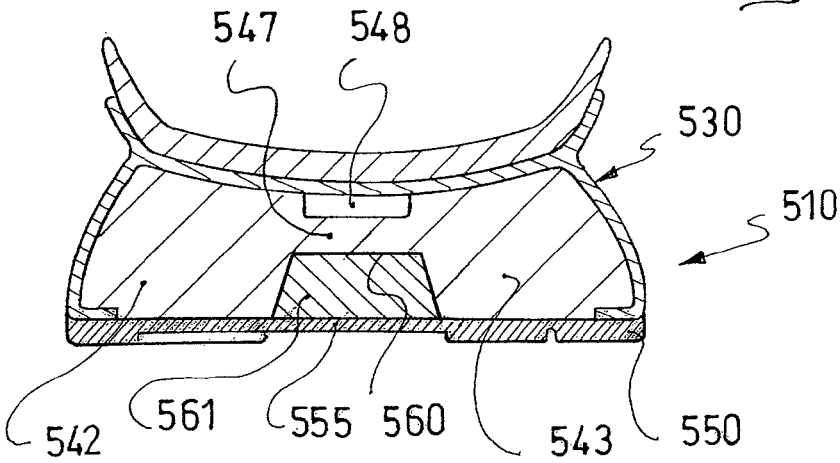
FIG. 14 is a view similar to FIG. 4 relating to a sixth embodiment.

In the embodiment of FIG. 14, the space 560 between two support elements 541, 543, 542 is filled by a material 561, such as EVA, PU, or gel.

However, a cavity 548 is arranged between the elastically deformable element 530 and the support elements 541, 543, 542 so as to keep the support elements independent, and a material wall 547 made of the same material as the support elements 542, 543, 541, is provided between the latter.

Figure 15:
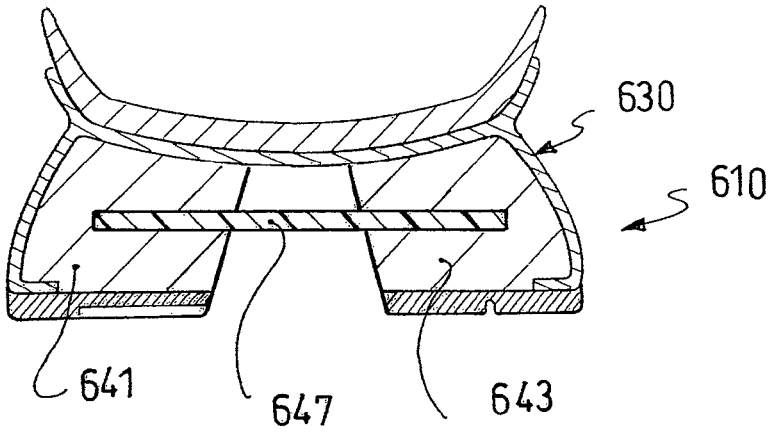
FIG. 15 is a view similar to FIG. 4 relating to a seventh embodiment.

In the embodiment of FIG. 15, an elastic return element 647 extending substantially horizontally is inserted between the support elements 641, 643, 642 in the same manner as in FIG. 8. The only difference lies in the fact that this return element 647 is, in this case, made of a different material, such as elastomeric rubber, for example. This element is further arranged substantially in the median portion, in the vertical direction of the support blocks.

Figure 16:
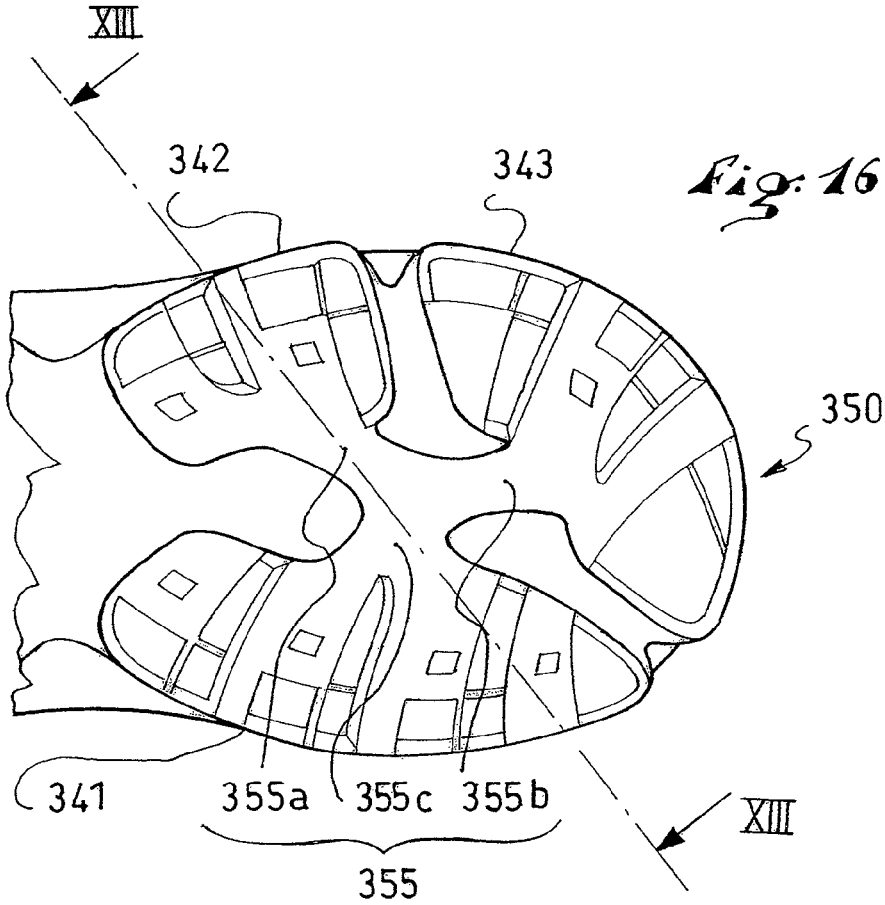
FIGS. 16 and 17 are bottom views of an bottom assembly according to an eighth and a ninth embodiment, respectively.
Figure 17:
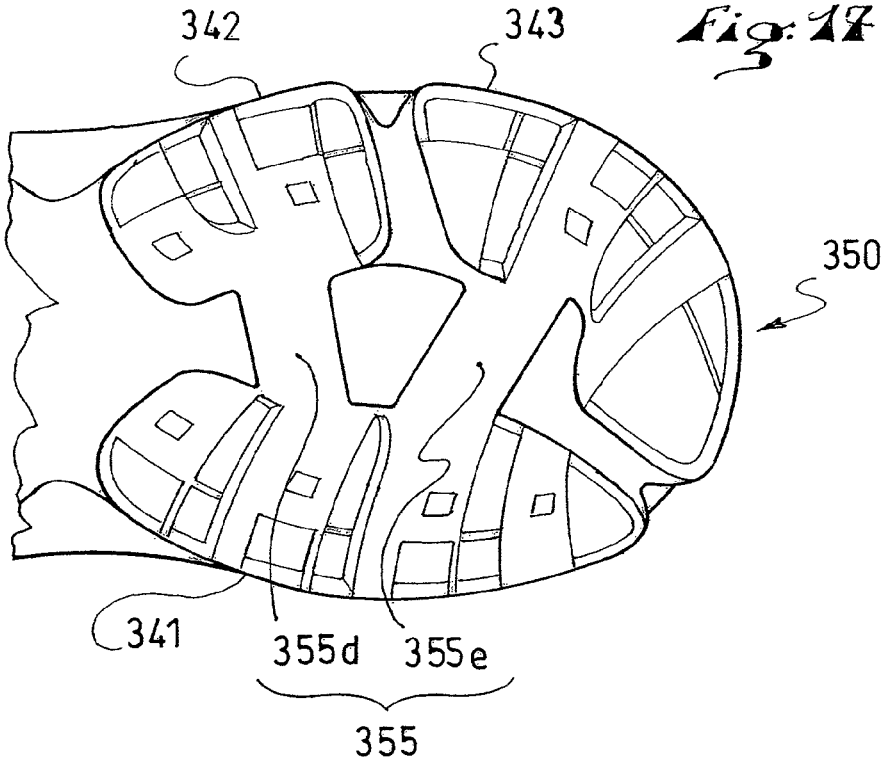

FIGS. 16 and 17 show different embodiments of the bottom of the bottom assembly of FIG. 12 (but also of FIGS. 13 to 14), i.e., in the case where the contact layer 350 includes a material wall 355 between two support blocks 341, 342, 343 to enable an elastic return of these blocks toward one another.

In FIG. 16, the material wall 355 includes three substantially similar arms 355*a*, 355*b*, 355*c* that each extend from a support block 342, 343, 341, respectively, and connect to one another, forming a star shape.

In FIG. 17, the material wall 355 only includes two arms 355*d*, 355*e*, respectively, each connecting two support blocks to one another, namely, the blocks 342, 341 and the blocks 343, 341, respectively.

The configuration of FIGS. 16 and 17 can also be applied to the embodiment of FIG. 15. In this case, it is the return element 647 that has a shape made of three arms 355*a*, 355*b*, 355*c*, or of two arms between the support blocks.

In the various embodiments, the number of arms 355*a*, 355*b*, 355*c* or 355*d*, 355*e* can be modified and, for example, can be as many as four or more, or less.

The present invention is not limited to the various embodiments described hereinabove by way of non-limiting examples, but encompasses all similar or equivalent embodiments.

The invention claimed is:

1. An article of footwear comprising:
an upper;
an outer bottom assembly beneath said upper, said outer bottom assembly comprising:
an upper end and a lower end;
a vertical longitudinal median plane;
a medial side of the vertical longitudinal median plane and a lateral side of the vertical longitudinal median plane;
a heel area;
in the heel area, at least two support elements comprising a shock-absorbing material, said two support elements comprising at least one support element extending at least on the medial side and at least one support element extending at least on the lateral side;
each of said two support elements having a height extending substantially from the upper end to substantially the lower end of the outer bottom assembly;
each of said two support elements being deformable substantially independently of one another;
an elastically deformable element comprising:
a base extending transversely with respect to the outer bottom assembly and covering an upper end of each of said two support elements;
at least two legs, a first of said two legs extending downwardly from the base of the elastically deformable element at least on the medial side, and a second of said two legs extending downwardly from the base of the elastically deformable element at least on the lateral side;
each of said two legs extends downwardly and outwardly from the base of the elastically deformable element, lowermost extents of said two legs being more widely spaced apart than uppermost extents;
said two legs extending over an external surface of an entirety of the heights of respective ones of said two support elements.

2. An article of footwear according to claim 1, wherein:
the elastically deformable element is affixedly assembled to each of the support elements.

3. An article of footwear according to claim 1, wherein:
each of said two legs of said elastically deformable element has a lower end fixed beneath the lower end of a respective one of said two support elements.

4. An article of footwear according to claim 1, wherein:
each of said support elements is provided with a ground contact layer at a lower end.

5. An article of footwear according to claim 1, wherein:
said at least two support elements comprises at least three support elements;
said at least one support element extending at least on the lateral side comprises at least two support elements extending at least on the lateral side.

6. An article of footwear according to claim 5, wherein:
one of said at least two support elements extending at least on the lateral side extends to a rear of the heel area.

7. An article of footwear according to claim 1, wherein:
each of said support elements is independently affixed to the elastically deformable element by its upper end.

8. An article of footwear according to claim 1, wherein:
the support elements have upper ends;
the support elements are affixed at their upper end to the elastically deformable element via a material wall.

9. An article of footwear according to claim 1, wherein:
the support elements are assembled together by means of an elastic material wall.

10. An article of footwear according to claim 9, wherein:
the elastic material wall comprises a rubber or other elastomeric material.

11. An article of footwear according to claim 10, wherein:
the outer bottom assembly further comprises a walking sole;
the elastic material wall extends upwardly from the walking sole.

12. An article of footwear according to claim 9, wherein:
the elastic material wall is arranged at lowermost ends of the support elements.

13. An article of footwear according to claim 9, wherein:
the elastic material wall is arranged substantially mid-height of the support elements.

14. An article of footwear according to claim 1, wherein:
the medial support element has a hardness greater than a hardness of the lateral support element.

15. An article of footwear according to claim 14, wherein:
the elastically deformable element further comprises a bowl-shaped portion arranged in the heel area of the outer bottom assembly;
the bowl-shaped portion comprising said base and edges upwardly extending from respective medial and lateral sides of the base.

16. An article of footwear according to claim 15, wherein:
the bowl-shaped portion extends up to a plantar arch area of the article of footwear.

17. An article of footwear according to claim 1, wherein:
the elastically deformable element is extended forwardly by two horizontally extending arms, a first of the two arms being on the medial side of the vertical longitudinal median plane and a second of the two aims being on the lateral side.

18. An article of footwear according to claim 1, wherein:
the outer bottom assembly further comprises a layer of shock-absorbing material arranged between the elastically deformable element and the upper.

19. An article of footwear according to claim 1, wherein:
the two support elements are made of a polymeric foam from a damping material.

20. An article of footwear according to claim 1, wherein:
the two support elements are made of EVA foam or PU foam.

21. An article of footwear according to claim 1, wherein:
the elastically deformable element is made of a material having a Young's Modulus of at least 40 MPa.

22. An article of footwear according to claim 1, wherein:
the outer bottom assembly has a loaded configuration, during use of the article of footwear, and an unloaded configuration;
a closed boundary line containing and abutting lowermost surfaces of the at least two support elements in said loaded configuration is larger than a closed boundary line containing and abutting the lowermost surfaces of the at least two support elements in the unloaded configuration.

23. An article of footwear according to claim 1, wherein:
each of the legs extends downwardly from the base of the elastically deformable element, terminating proximate a lowermost surface of a respective one of the support elements.

24. An article of footwear according to claim 1, wherein:
each of the legs extends downwardly from the base of the elastically deformable element, terminating at a downwardly facing free end.

25. An article of footwear comprising:
an upper;
an outer bottom assembly beneath said upper, said outer bottom assembly comprising:
an upper end and a lower end;
a vertical longitudinal median plane;
a medial side of the vertical longitudinal median plane and a lateral side of the vertical longitudinal median plane;
a heel area;
in the heel area, at least three support elements comprising a shock-absorbing material, said three support elements comprising at least one support element extending at least on the medial side and at least one support element extending at least on the lateral side;
each of said three support elements having a height extending substantially from the upper end to substantially the lower end of the outer bottom assembly;
each of said three support elements being deformable substantially independently of one another;
an elastically deformable element comprising:
a base extending transversely with respect to the outer bottom assembly and covering an upper end of each of said two support elements;
at least three legs, a first of said three legs extending downwardly from the base of the elastically deformable element at least on the medial side, and a second of said three legs extending downwardly from the base of the elastically deformable element at least on the lateral side;
the three legs extending over an external surface of an entirety of the heights of respective ones of the three support elements.

26. An article of footwear comprising:
an upper;
an outer bottom assembly beneath said upper, said outer bottom assembly comprising:
an upper end and a lower end;
a vertical longitudinal median plane;
a medial side of the vertical longitudinal median plane and a lateral side of the vertical longitudinal median plane;
a heel area;
a rigid but elastically deformable element comprising:
a base extending transversely substantially across an entirety of a width of the heel area of the outer bottom assembly;
edges extending upwardly from respective medial and lateral sides of the base;
at least two legs extending downwardly from the base, a first of said two legs extending at least on the medial side of the base and a second of said two legs extending at least on the lateral side of the base;
in the heel area of the outer bottom assembly, at least two support elements comprising a compressible shock-absorbing material;
a first of the two support elements extending downwardly from beneath the base of the elastically deformable element at least on the medial side of the outer bottom assembly;
a second of the two support elements extending downwardly from beneath the base of the elastically deformable element at least on the lateral side of the outer bottom assembly;
each of the two support elements being compressibly deformable substantially independently of one another;
the two legs of the elastically deformable element extending over an external surface of an entirety of heights of respective ones of the two support elements.

27. An article of footwear according to claim 26, wherein:
the outer bottom assembly has a loaded configuration, during use of the article of footwear, and an unloaded configuration;
a closed boundary line containing and abutting lowermost surfaces of the at least two support elements in said loaded configuration is larger than a closed boundary line containing and abutting the lowermost surfaces of the at least two support elements in the unloaded configuration.

28. An article of footwear according to claim 26, wherein:
each of the legs has a free end located proximate a lowermost surface of a respective one of the support elements.

29. An article of footwear according to claim 26, wherein:
each of the legs has a downwardly facing free end proximate a lower surface of a respective one of the support elements.

30. An article of footwear according to claim 26, wherein:
each of the two legs extends downwardly and outwardly from the base of the elastically deformable element, lowermost extents of the two legs being more widely spaced apart than uppermost extents.

31. An article of footwear comprising:
an upper;
an outer bottom assembly beneath said upper, said outer bottom assembly comprising:
an upper end and a lower end;
a vertical longitudinal median plane;
a medial side of the vertical longitudinal median plane and a lateral side of the vertical longitudinal median plane;
a heel area;
in the heel area, at least two support elements comprising a shock-absorbing material, said two support elements comprising at least one support element extending at least on the medial side and at least one support element extending at least on the lateral side;

each of said two support elements having a height extending substantially from the upper end to substantially the lower end of the outer bottom assembly;

each of said two support elements being deformable substantially independently of one another;

an elastically deformable element comprising:

a base extending transversely with respect to the outer bottom assembly and covering an upper end of each of said two support elements;

edges extending upwardly from respective medial and lateral sides of the base;

at least two legs, a first of said two legs extending downwardly from the base of the elastically deformable element at least on the medial side, and a second of said two legs extending downwardly from the base of the elastically deformable element at least on the lateral side;

said two legs extending over an external surface of an entirety of the heights of respective ones of said two support elements.

32. An article of footwear according to claim 31, wherein:

each of said two support elements include inner and outer surfaces;

said inner surface of each of the two support elements extends from an uppermost extent to a lowermost extent, with the lowermost extents of the inner surfaces of the two support elements also being outermost transverse extents of each of the inner surfaces of the two support elements.

* * * * *